US011542697B2

(12) United States Patent
Guthrie et al.

(10) Patent No.: US 11,542,697 B2
(45) Date of Patent: Jan. 3, 2023

(54) GEAR-DRIVEN TRIP LEVER WITH CLUTCH ASSEMBLY

(71) Applicant: Lavelle Industries, Inc., Burlington, WI (US)

(72) Inventors: Kevin J. Guthrie, Wind Lake, WI (US); Jordan Smith, Waukesha, WI (US)

( * ) Notice: Subject to any disclaimer, the term of this patent is extended or adjusted under 35 U.S.C. 154(b) by 197 days.

(21) Appl. No.: 17/153,489

(22) Filed: Jan. 20, 2021

(65) Prior Publication Data

US 2021/0222415 A1 Jul. 22, 2021

Related U.S. Application Data

(60) Provisional application No. 62/963,390, filed on Jan. 20, 2020.

(51) Int. Cl.
*E03D 5/092* (2006.01)
*E03D 1/34* (2006.01)

(52) U.S. Cl.
CPC ..... *E03D 5/092* (2013.01); *E03D 1/34* (2013.01)

(58) Field of Classification Search
CPC ..... E03D 1/02–125; E03D 1/14–145; E03D 1/20; E03D 5/003–006; E03D 5/02; E03D 5/026; E03D 5/04–08; E03D 5/09–094; E03D 5/12
See application file for complete search history.

(56) References Cited

U.S. PATENT DOCUMENTS 3,091,775 A 6/1963 Himmelrick
4,056,856 A 11/1977 Reid et al.
4,058,858 A 11/1977 Che-Wi
4,764,995 A 8/1988 Harney
4,817,216 A 4/1989 Auman
5,319,809 A 6/1994 Testa
8,393,018 B2 3/2013 Huang
8,418,276 B2 4/2013 Huang
9,032,560 B2 5/2015 Lambert et al.
9,803,350 B2 * 10/2017 Guthrie ..... E03D 5/09
9,834,918 B2 * 12/2017 Veros ..... E03D 5/026
10,047,509 B2 8/2018 Schuster et al.
2010/0050331 A1 3/2010 Sim
2018/0230684 A1 * 8/2018 Han ..... E03D 5/092

FOREIGN PATENT DOCUMENTS

KR 1019800000394 5/1980

* cited by examiner

*Primary Examiner* — David P Angwin
*Assistant Examiner* — Nicholas A Ros
(74) *Attorney, Agent, or Firm* — Joseph S. Heino; Erin E. Kaprelian

(57) ABSTRACT

A gear driven trip lever for a toilet comprises a handle, a handle stop and a torsion spring disposed outside the tank. Inside the tank is a gear driven trip lever subassembly comprising a home position rack that is secured to a mounting plate and a spring-loaded clutch cam. The end of the flush lever nearest the gear driven trip lever subassembly is configured as a geared structure that meshes with gears disposed on a home position rack. When a user pushes the flush handle, the home position rack lifts the geared flush lever. The clutch cam contacts and slides on the home position rack as it moves downwardly. When the flush handle is fully depressed downwardly, the clutch cam releases the home position rack which returns to its home position via a compression spring and the geared flush lever is returned to its home position.

9 Claims, 8 Drawing Sheets

GEAR-DRIVEN TRIP LEVER WITH CLUTCH ASSEMBLY

PRIORITY CLAIM

This application claims priority to Provisional Patent Application No. 62/963,390 filed on Jan. 20, 2020, the contents of which are hereby incorporated by reference.

FIELD OF THE INVENTION

The present invention relates generally to plumbing fixtures and to the component parts that are used in them. It also relates to a mechanical structure that allows a user to not control the open and close time of a flapper valve or a flush valve canister of the type that are used in gravity flush toilets. It also relates generally to flush levers and flush lever actuation devices. More specifically, the present invention relates to a clutch, which is a mechanical device which engages and disengages, in the form of a gear-driven trip for a toilet flush lever, the device having a clutch cam and clutch release mount assembly for actuating the flush lever.

BACKGROUND OF THE INVENTION

Conventional toilets typically employ a number of essential components. First, a porcelain water tank is mounted immediately above a porcelain bowl from which a quantity of water is rapidly drained in order to flush waste from the bowl into a sewer system. One very common design uses a flapper valve made of an elastomeric material that covers the drain outlet of the tank. When the flush handle on the outside of the tank is manually actuated, typically by pushing the handle downwardly, the flapper valve is lifted by means of a flush lever via a chain or other connecting means. This allows the head of water in the tank to drain through the flush valve and the drain outlet. The flapper valve is typically designed with an inverted air chamber so that it initially floats as it is lifted away from the drain outlet in the bottom of the tank. This allows sufficient flushing water to flow into the bowl even if the user immediately releases the flush handle. When the water level in the tank drops, the tank is automatically refilled through a fill valve connected to a water supply line.

Current flush levers used with toilet tanks typically comprise a rotatable handle disposed to the tank exterior, a flush lever disposed within the tank interior and a mechanical coupling disposed between the rotatable handle and the flush lever. Actuation of the flush lever is accomplished by pushing the end of the rotatable handle downwardly (or rearwardly depending on the handle's orientation), thereby lifting the flush lever about a central pivot point. All of this mechanical action relies essentially on gravity, the flush lever and flapper valve typically being heavier than the flush handle, and on the flotation of the flapper valve within the tank.

In the view of these inventors, there is a need to allow the flush lever and the rotatable handle to be configured such that it can be operated in a way that does not allow the user to control the open and close time of the flapper or canister.

SUMMARY OF THE INVENTION

In accordance with the foregoing, a gear driven trip lever and assembly has been devised by these inventors which accomplishes the goal identified above. As used in this summary, the term "flush handle" means the handle disposed outside the toilet tank for flush actuation by the user and the interior "flush lever" means the interior lever that is mechanically coupled to the flush handle and is used to open and close the flapper or canister disposed within the toilet tank, typically via a chain or other structure. The mechanical coupling between the flush handle and the flush lever is the "gear driven trip lever" and the gear driven trip lever as used with a conventional water tank, for purposes of this disclosure, comprises an "assembly."

More specifically, the gear driven trip lever of the present invention comprises a handle, a handle stop and a torsion spring, all of which is disposed to the exterior of the tank. Disposed within the tank is a gear driven trip lever subassembly, the subassembly comprising means for mechanically linking the flush lever with the handle via the subassembly and includes a clutch cam. Opposite a tank hole seal is a mounting plate, a drive pin and a lock nut.

The gear driven trip lever subassembly comprises a clutch release mount, a home position rack that is secured to the mounting plate and a spring-loaded clutch cam that is secured to the clutch release mount via a retaining pivot pin. The end of the flush lever nearest the gear driven trip lever subassembly is uniquely configured as a partially geared structure such that it can mesh with gears disposed on a home position rack.

When a user pushes the flush handle, this allows the home position rack to move downwardly but also lifts the geared flush lever. The clutch cam contacts and slides on the home position rack as it moves downwardly. When the flush handle is fully depressed downwardly, the clutch cam releases the home position rack which returns to its home position via a compression spring and the geared flush lever is returned to its home position. The clutch cam has a return torsion spring which allows the clutch cam to flex inward so it can reset to its home position.

The foregoing and other features of the gear driven trip lever and assembly of the present invention will be apparent from the following detailed description when read in conjunction with the accompanying drawings.

DETAILED DESCRIPTION

Figure 1:
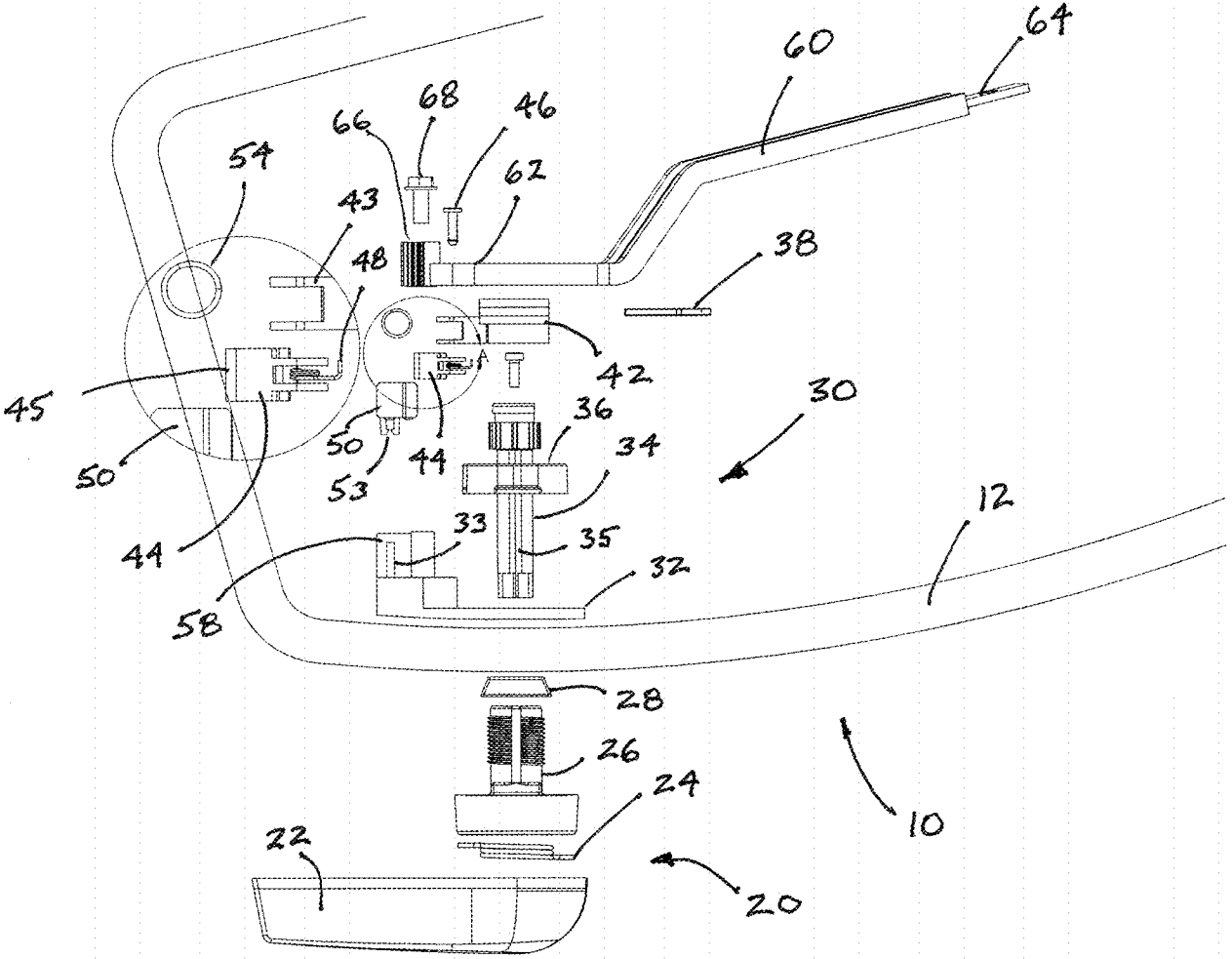
FIG. 1 is a top plan view of a portion of a toilet tank and showing the elements of the gear driven trip lever constructed in accordance with the present invention, the elements thereof being shown in exploded view and one element thereof being a gear-driven clutch cam.

Referring now to the drawings in detail, wherein like-numbered elements refer to like elements throughout, FIG. 1 illustrates a top plan view of a gear driven trip lever assembly, generally identified 10, of the present invention, which flush lever assembly 10 is the type that would be mounted in the wall 12 of a toilet tank (the assembly including the toilet tank wall 12) via a hole or other opening (not shown). The tank hole is generally square in shape so as to allow for a toilet flush handle to be positioned in a variety of ways. As shown, there is an outer gear driven trip lever subassembly, generally identified 20, that comprises a toilet flush handle 22, a torsion spring 24, a handle stop 26 and a tank hole seal 28. Significantly, the torsion spring 24 is used in conjunction with the handle stop 26 to reposition the flush handle 22 following each flush of the toilet.

More specifically, the torsion spring refers to a particular variety of spring that functions through twisting of the end(s) of the spring along the spring's axis. When twisted, a torsion spring, such as torsion spring 24, exerts a torque in the direction opposite the twisting, allowing mechanical energy to be stored within the spring itself. In the case of torsion spring 24, the end is twisted when handle 22 is depressed or pushed down (i.e., when the toilet is flushed). This stores mechanical energy within torsion spring 24, which will be used to return the handle 22 to its neutral or home position.

Figure 6:
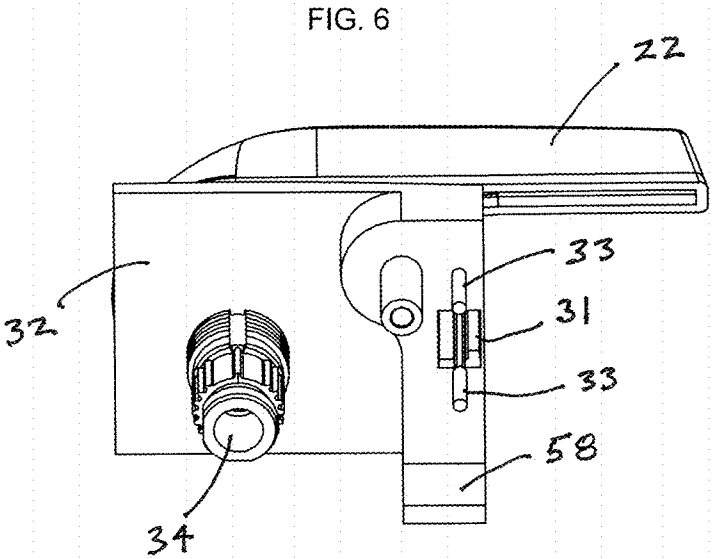
FIG. 6 is a top and rear perspective view showing the toilet flush handle, the mounting plate (without an interposed toilet tank wall) and the drive pin of the gear driven trip lever.
Figure 7:
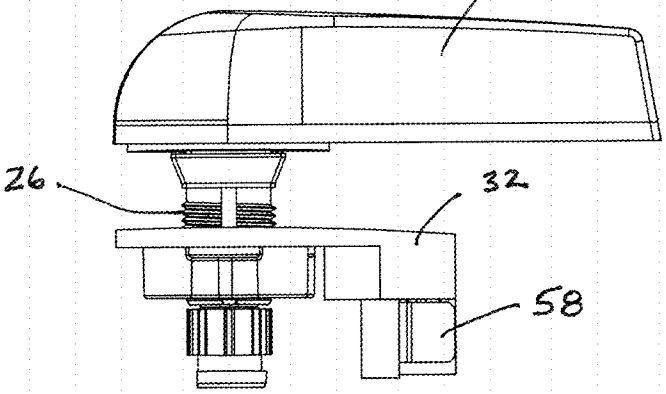
FIG. 7 is a top plan view of the elements shown in FIG. 6 together with a lock nut, also without an interposed toilet tank wall.

FIG. 1 also shows the elements of the gear driven trip lever assembly 10 that are disposed within the tank wall 12. A portion of those elements comprise an inner tank subassembly, generally identified 30, and include a mounting plate 32, a drive pin 34 and a lock nut 36. The drive pin 34 is configured to pass through the mounting plate 32 and into the handle stop 26. The drive pin 34 is the structure that translates rotational motion of the flush handle 22 on the outside of the tank wall 12 to structure inside the tank wall 12. The flush handle 22 further includes a torsion spring 24. When the handle 22 is pushed down, the torsion spring 24 loads. When the handle 22 is released, it returns to its "home" or level position. See also FIGS. 6 and 7. Lastly, the drive pin 34 includes a polarizing structure 35 to allow for proper positioning and alignment of the mounting plate 32.

Figure 9:
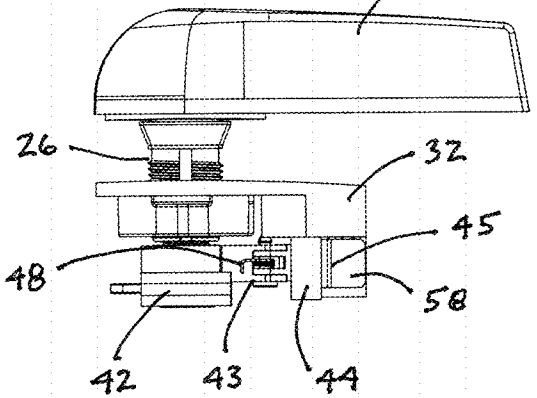
FIG. 9 is another top plan view similar to FIG. 7 but showing the added clutch release mount, the return spring and the retaining pivot pin for the clutch cam. A retaining clip is also shown.
Figure 8:
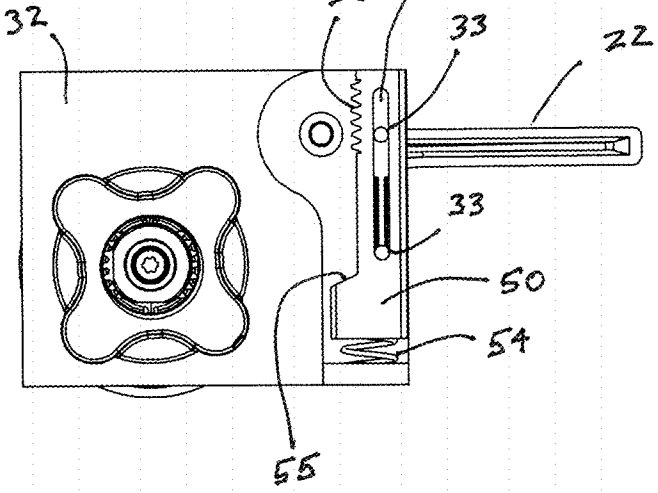
FIG. 8 is a rear elevational view of the elements shown in FIGS. 6 and 7 and also showing the home position rack and compression spring, also without an interposed toilet tank wall.
Figure 11:
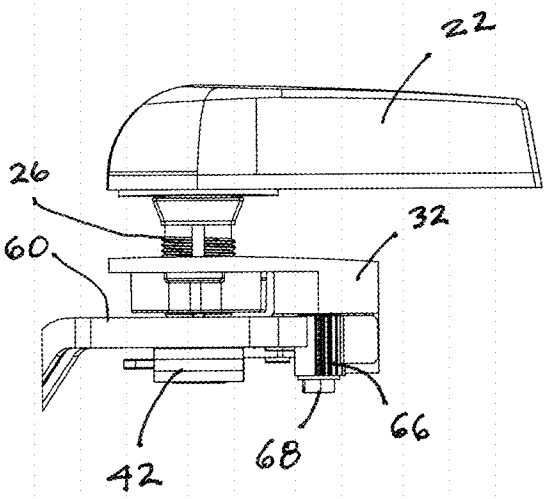
FIG. 11 is another top plan view similar to FIGS. 7 and 9 but showing the geared lever arm portion that is proximal to the clutch cam.
Figure 10:
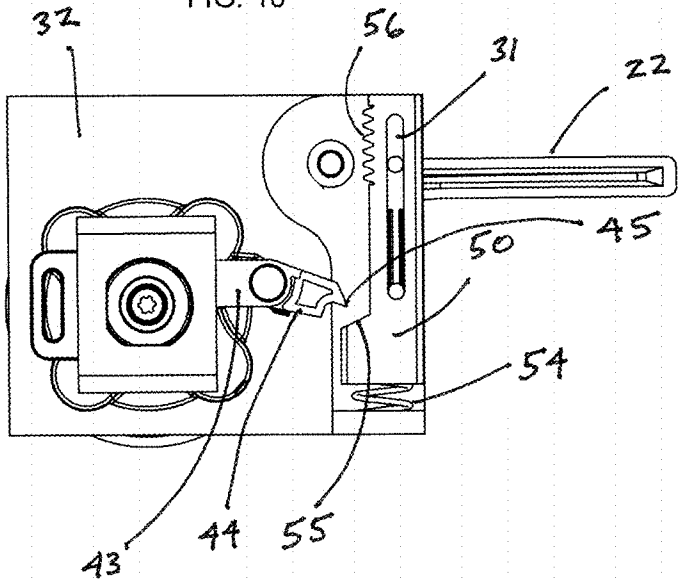
FIG. 10 is a rear elevational view of what is shown in FIG. 9 but showing the clutch cam in a pre-flush position.
Figure 12:
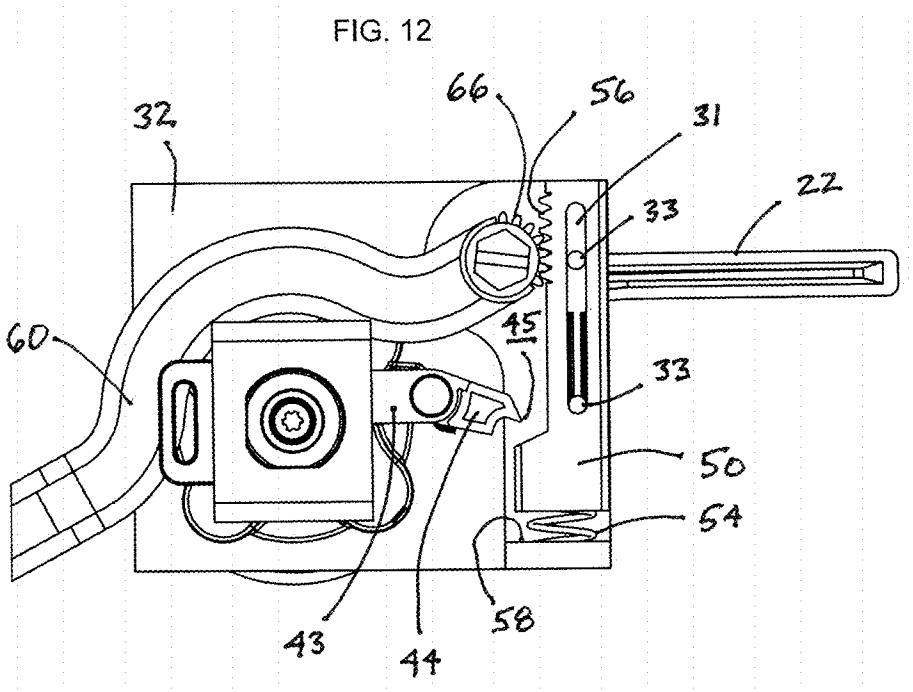
FIG. 12 is another rear elevational view similar to FIGS. 8 and 10 but showing the geared lever arum engaged with the home position rack, also in a pre-flush position.

Continuing with FIG. 1, it further illustrates a clutch release mount 42 that is secured to the end of the drive pin 34 by use of a retaining clip 38. As used herein, a retaining clip refers to a generally U-shaped or semicircular clip sized to selectively hold and lock two pieces of material together. To one side of the clutch release mount 42 is a receiving portion 43. See also FIG. 9. The receiving portion 43 comprises two tab-like structures that provide an opening therebetween for receiving a clutch cam 44. The clutch cam 44 is rotatably mounted within the receiving portion 43 of the time release mount 42 via a retaining pivot pin 46. However, the clutch cam 44 and the receiving portion 43 of the clutch release mount may, in an alternative embodiment, be snap-fitted therein, although examples are not so limited and other coupling structure may be used. The inner subassembly further includes a home position rack 50. See also FIGS. 6 and 7. The home position rack 50 includes structure for securing the rack 50 to the mounting plate 32 while also allowing the rack 50 to limitedly move vertically along the mounting plate 32. This is accomplished via the rack 50 having attachment structures 53 disposed to its front side that can secure it to the mounting plate 32 but also limit its upward and downward movement via a slot 31 defined in the rack 50 and a pair of pins 33 that extend rearwardly of the mounting plate 32. See FIGS. 6 and 8. A flat 58 is also included in the mounting plate 32 such that a compression spring 54 can urge the rack 50 upwardly. See also FIGS. 8, 10 and 12 where it will be appreciated that the compression spring 54 is disposed toward the bottom portion of the rack 50.

Figure 2:
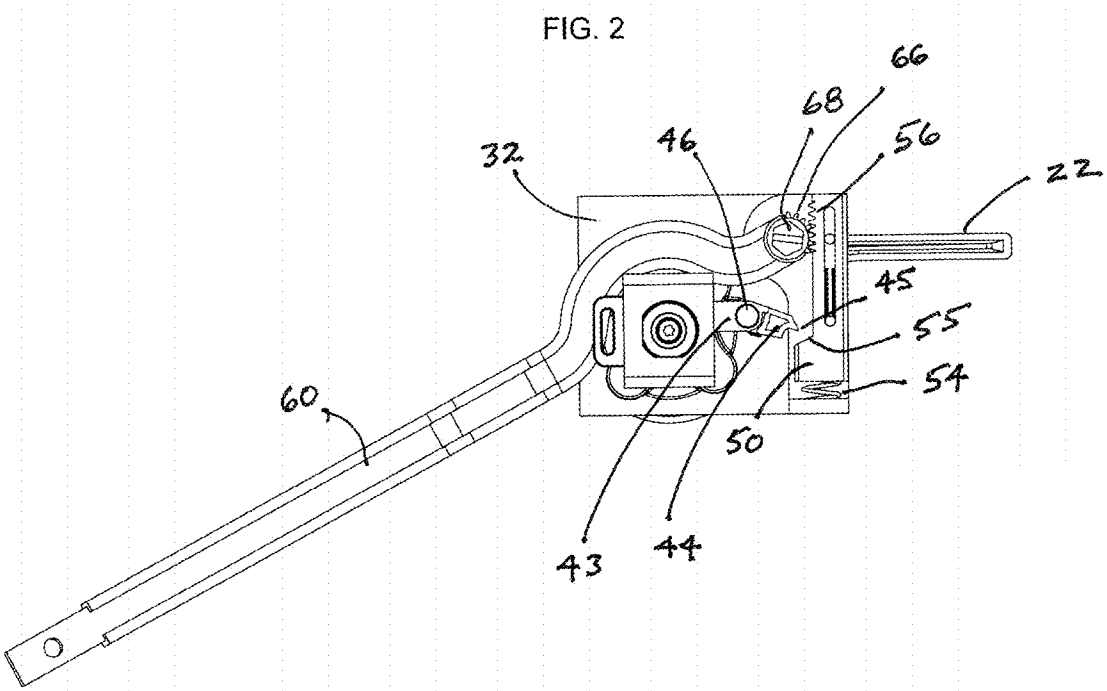
FIG. 2 is a rear elevational view of the gear driven trip lever as viewed from within the tank and showing the gear driven trip lever in its home position prior to a user pushes the toilet flush handle shown in FIG. 1.
Figure 3:
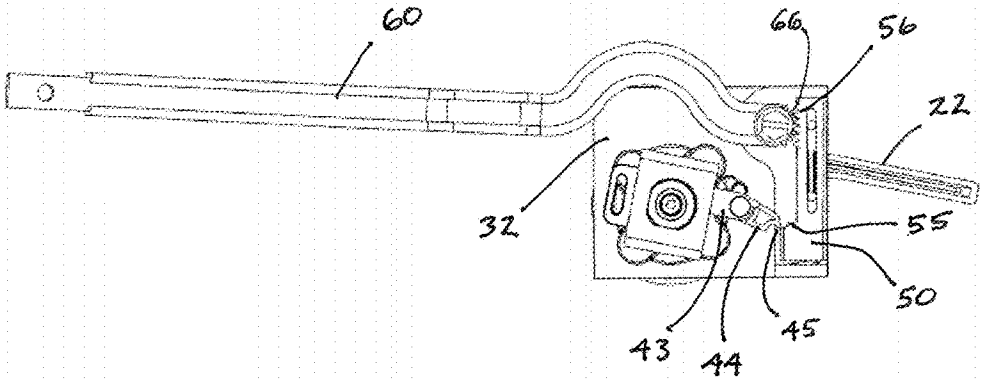
FIG. 3 is a rear elevational view similar to that shown in FIG. 2 but showing position of the gear driven trip lever following the user having pushed the toilet flush handle.
Figure 4:
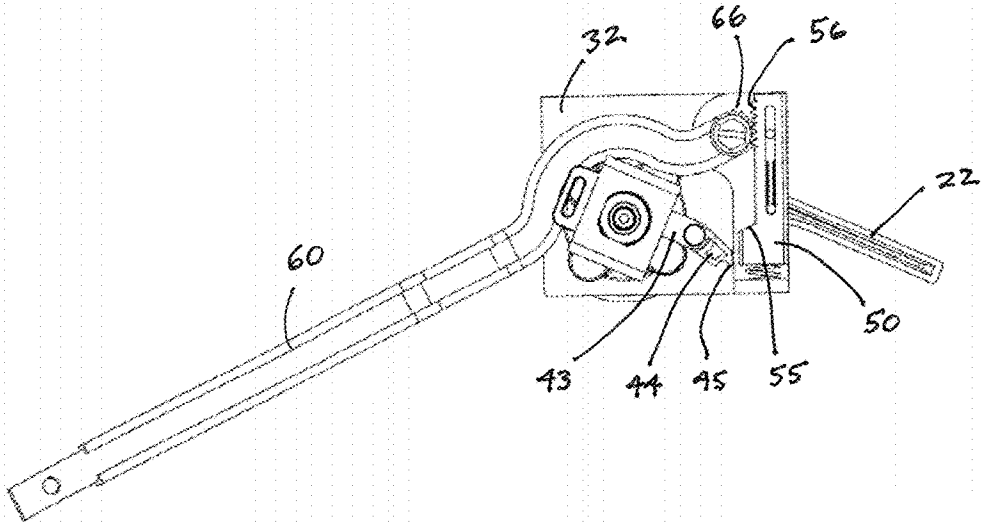
FIG. 4 is a rear elevational view similar to that shown in FIGS. 2 and 3 and showing position of the gear driven trip lever after the user releases the toilet flush handle.

Gear teeth 56 are defined at the upper portion of the rack 50. Again, see FIGS. 8, 10 and 12. The gear teeth 56 are intended to mesh with like teeth 66 that are defined in a proximal end 62 of a geared flush lever 60. The flush lever 60 is held in place by, but still rotatable about, a fastener 68 disposed at the proximal end 62, the fastener 68 being received by the mounting plate 32 as is shown in FIG. 2, for example. The distal end 64 of the flush lever 60 includes means for attaching that end to a flush valve or canister of known manufacture. Disposed medially of the rack 50 is an angled surface 55. Lastly, the clutch cam 44 includes a return spring 48 which is used to reposition the clutch cam 44 after each flush, as is shown in FIGS. 2-5.

In application, the pre-flush or "home" positions of the components of the assembly 10 are best represented by FIG. 2. To initiate a flush cycle, a user pushes the handle 22 down, keeping in mind that the handle 22 is held in its "home" position by means of the torsion spring 24, the torsion spring 24 "loading" when the handle 22 is pushed down. This results in the clutch release mount 42 and the clutch cam 44 being rotated such that the clutch cam 44 moves downwardly. See FIG. 3. At the same time, the tip 45 of the clutch cam 44 comes in contact with the angled surface 55 on the home position rack 50. The home position rack 50 moves downwardly, compressing the compression spring 54 while the gear teeth 56 of the rack 50 mesh with the gear teeth 66 of the flush lever 60, which lifts the lever 60 to a flush position.

Figure 5:
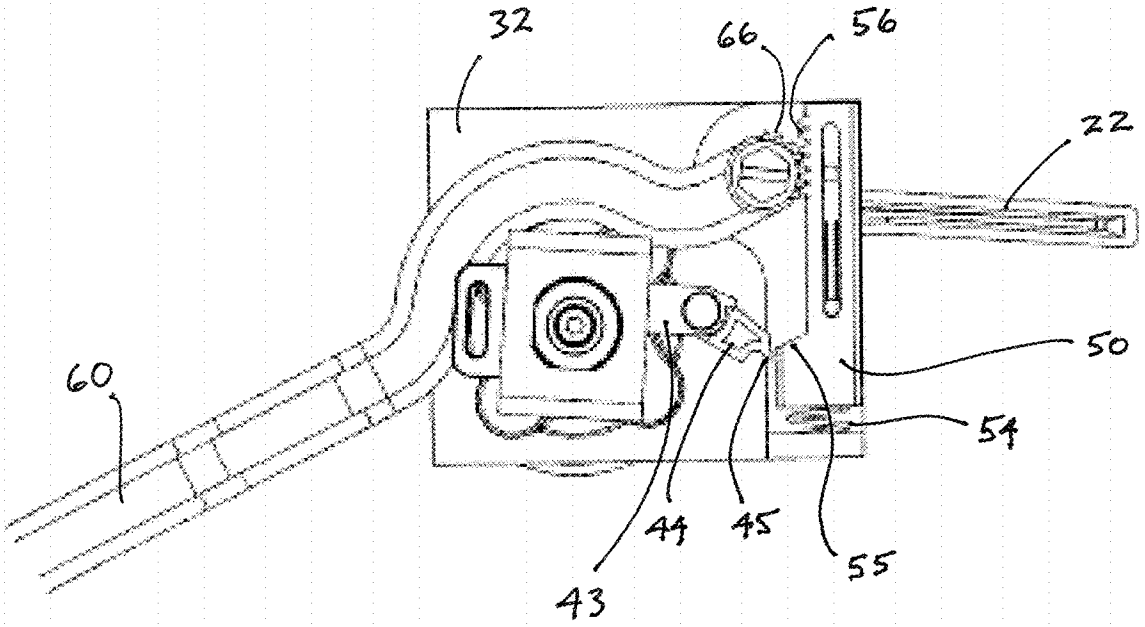
FIG. 5 is a rear elevational view similar to that shown in FIGS. 1 through 4 after a return torsion spring has allowed the clutch cam to flex inwardly so it can reset to its home position as shown in FIG. 1.

The clutch cam tip 45 eventually runs out of contact surface on the angled surface 55 of the rack 50. This allows the compression spring 54 to push the rack 50 back up to the "home" position, thereby sending the flush lever back to its home position as well. See FIG. 4. The clutch cam 44 is in the down position until the user releases the handle 22. When the handle 22 is released, the return spring 24 takes the handle 22 back to its home position. It is also to be noted that the clutch cam 44 also has a return torsion spring 48 that allows the clutch cam 44 to flex inward so it can reset to its home position as shown in FIG. 5.

It is to be noted that the clutch cam 44 can be sized to allow different engagements of its tip 45 with the home position rack angled surface 55 to create different flush lever 60 strokes. Further, the mounting plate 32 can have different contours to match different internal shapes of tanks.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

Elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. A toilet trip lever assembly for use with a toilet tank, comprising:

an outer tank trip lever subassembly, wherein the outer tank trip lever subassembly comprises:
- a handle;
- a handle stop;
- a torsion spring disposed between the handle and the handle stop; and
- a tank hole seal; and an inner tank subassembly, wherein the inner tank subassembly further comprises:
- a mounting plate to receive a portion of the outer subassembly;
- a drive pin coupled to the mounting plate;
- a flush lever;
- a clutch release mount;
- a clutch cam; and
- a home position rack.

2. The toilet trip lever assembly of claim 1, wherein the clutch release mount further comprises a receiving portion and structure to attach the clutch cam to the receiving portion and for rotation of the clutch cam within the clutch release mount.

3. The toilet trip lever assembly of claim 2, wherein the clutch cam comprises a return spring to reposition the clutch cam following a flush cycle.

4. The toilet trip lever assembly of claim 3, wherein the flush lever of the inner tank subassembly further comprises:
- an end that is proximal to the mounting plate;
- an end that is distal to the mounting plate;
- teeth that are defined in the proximal end of the flush lever; and
- structure for attaching the distal end of the flush lever to a flush valve or canister.

5. The toilet trip lever assembly of claim 4, wherein the home position rack further comprises:
- structure for securing the rack to the mounting plate;
- structure for allowing for limited vertical movement of the rack relative to the mounting plate;
- an upper portion;
- gear teeth defined within the upper portion of the rack;
- a bottom portion; and
- an angled surface defined between the upper portion and the bottom portion.

6. The toilet trip lever assembly of claim 5, wherein the clutch cam comprises a tip and the angled surface of the home position rack is a surface that is contacted by the tip of the clutch cam during a flush cycle.

7. The toilet trip lever assembly of claim 6, wherein the home position rack further comprises a spring disposed within the bottom portion of the home position rack to allow for downward movement of the rack together with spring compression and for upward movement of the rack together with spring decompression.

8. The toilet trip lever assembly of claim 7, wherein decompression of the rack spring moves the rack up to a "home" position.

9. The toilet trip lever assembly of claim 8, wherein rack further comprises a slot and the mounting plate further comprises a pair of pins that extend rearwardly of the mounting plate and extend into the slot to limit upward and downward movement of the rack.

* * * * *